US005103141A

United States Patent [19]

Keijser et al.

[11] Patent Number: 5,103,141

[45] Date of Patent: Apr. 7, 1992

[54] SWITCHING ARRANGEMENT FOR INCREASING THE WHITE LIFE OF A HIGH PRESSURE SODIUM LAMP

[75] Inventors: Robertus A. J. Keijser; Petrus A. M. Weerdestein, both of Eindhoven, Netherlands

[73] Assignee: U.S. Philips Corporation, New York, N.Y.

[21] Appl. No.: 652,807

[22] Filed: Feb. 7, 1991

[30] Foreign Application Priority Data

Mar. 8, 1990 [NL] Netherlands ..... 9000531

[51] Int. Cl.[5] ..... H05B 41/36

[52] U.S. Cl. ..... 315/307; 315/209 R; 315/DIG. 7

[58] Field of Search ..... 315/307, 308, 291, 209 R, 315/DIG. 5, DIG. 7, 362, DIG. 2

[56] References Cited

U.S. PATENT DOCUMENTS 4,039,897 8/1977 Dragoset ..... 315/307 X
4,455,510 6/1984 Lesko ..... 315/DIG. 7 X
4,952,846 8/1990 Van Der Burgt et al. ..... 315/307 X

FOREIGN PATENT DOCUMENTS 0228123 8/1987 European Pat. Off. .

*Primary Examiner*—Eugene R. LaRoche
*Assistant Examiner*—Ali Neyzari
*Attorney, Agent, or Firm*—Brian J. Wieghaus

[57] ABSTRACT

The invention relates to a switching arrangement for operating a high-pressure sodium lamp which radiates white light in stable operating conditions. The switching arrangement is provided with switching means for switching current through the lamp by means of a drive signal generated in a drive circuit, which signal is based on a comparison between a reference value C and drive signal $V+\beta I$, in which V is the lamp voltage, I is the lamp current, and $\beta$ is a constant. According to the invention, C may be adjusted in steps in dependence on the lamp voltage. Thus the duration over which the lamp radiates white light can be prolonged and brought into better accordance with the electrical lamp life.

15 Claims, 1 Drawing Sheet

SWITCHING ARRANGEMENT FOR INCREASING THE WHITE LIFE OF A HIGH PRESSURE SODIUM LAMP

BACKGROUND OF THE INVENTION

1. Field of the Invention

The invention relates to a switching arrangement, or control circuit, for operating a high-pressure sodium lamp which radiates white light in stable operating conditions, which switching arrangement is provided with switching means for switching current through the lamp by means of a drive signal generated in a drive circuit and derived from a comparison between a reference value C and a drive signal having the form $V+\beta I$, where V is the lamp voltage, I is the lamp current, and $\beta$ is a constant.

2. Description of the Prior Art

A switching arrangement of the kind described in the opening paragraph is known from the European Patent Application EP-A-0228123. An important characteristic of the known switching arrangement is that the lamp voltage is kept constant by fair approximation, so that the colour temperature $T_c$ of the light radiated by the lamp remains within acceptable limits during a longer period. It is important to limit the change of the colour temperature $T_c$ in view of the characteristic that the lamp radiates "white light". As a rule, it is true for these lamps that the colour temperature $T_c>2250$ K. The area in the colour triangle within which the light of a high-pressure sodium lamp is called "white" is limited by straight lines through the points having coordinates (x, y): (0.400; 0.430), (0.510; 0.430), (0.485; 0.390) and (0.400; 0.360). The colour temperature $T_c$ in that case lies between approximately 2300 K. and 4000 K. According to more stringent requirements, based on a better acceptation of the light by observers, the light is called "white" if it lies in an area of the colour triangle bounded by the lines $x=0.468$, $x=0.490$, $y=0.408$ and $y=0.425$. The colour temperature then lies between approximately 2300 K. and approximately 2700 K. Lamps of the type described may be used to replace incandescent lamps.

It has been found, however, that the reasonable maintainance at a constant level of the lamp voltage by means of the known switching arrangement does not prevent the colour temperature $T_c$ showing a drift during lamp life and generally falling to such a level that the colour point of the light radiated by the lamp will move outside the area indicated as the area of "white light".

Based on the colour of the light radiated by the lamp then, the lamp can be regarded as having reached the end of its "white" life. The lamp has by no means reached the end of its electrical life then, however.

SUMMARY OF THE INVENTION

The invention has for its object to increase the "white" lamp life so that it corresponds more closely to the electrical lamp life.

In order to achieve this object, a switching arrangement of the kind described in the opening paragraph is characterized in that it comprises a drive circuit with means for adjusting the reference value C in dependence on the lamp voltage. A change in C corresponds to a change in the balance of electrical parameters of the lamp. It has been found that a suitable adjustment of the value of C can influence the colour point $T_c$ in such a way that a drift of $T_c$ occurring over a longer period can be compensated to a considerable degree.

The colour temperature $T_c$ of the radiation emitted by lamps containing sodium as a filling constituent is related to the pressure of the sodium in the discharge vessel of the lamp. If the filling is present in excess quantity in the discharge vessel, the sodium pressure is dependent on the temperature of the sodium present in excess. The discharge vessel filling of high-pressure sodium discharge lamps usually consists of a sodium-mercury amalgam and a rare gas. The composition and temperature of the amalgam is important for the lamp voltage in this case, since the latter is a function of the relative Na and Hg pressures. As a result, keeping constant of the lamp voltage will in principle lead to keeping constant of the Na and Hg pressures.

It is a phenomenon which is known per se, however, that an increasing power is required for maintaining the same lamp voltage during lamp life, inter alia as a result of physical and chemical reactions which lead to, among other effects, blackening of the lamp vessel extremities. Lamp voltage drive by means of the known switching arrangement leads in practice to an Na pressure which is not kept constant.

If, on the other hand, the balance of electrical parameters at which the lamp is operated is changed in the known switching arrangement, the Na pressure can be restored to the value corresponding to the desired colour temperature in the circumstances described. Since the sodium pressure, owing to the blackening which occurs, has a tendency to fall slowly in the course of time, a restoration of the sodium pressure by changing the balance of electrical parameters of the lamp will be accompanied by an increase in the power consumed by the lamp. The lamp will then be more strongly loaded electrically then. An important advantage of this is that a lengthening of the "white" lamp life is accompanied by a shortening of the electrical lamp life.

Since the process in which the lamp voltage changes owing to blackening takes place relatively slowly, the drive circuit is preferably designed in such a way that C is adjusted in steps. In a preferred embodiment of the switching arrangement according to the invention, the means for adjusting the reference value C serve to reduce C when the lamp voltage exceeds a preset upper level. The inventors have found in this connection that the means for adjusting the reference value C advantageously comprise a window comparator for comparing the lamp voltage with the preset upper level. It is possible with the window comparator to compare not only with the preset upper level, but also with a lower level in an effective way. Comparison with a lower level is important in order to prevent that the adjustment of the reference value C in the drive circuit leads to such a drive signal that the lamp extinguishes. The risk that the lamp extinguishes is caused by the characteristic of a high-pressure sodium lamp that, when the average lamp current changes abruptly, the average lamp voltage changes abruptly with an inverted polarity, and only afterwards gradually changes with the same polarity as that of the current change until a stable balance of electrical parameters belonging to the changed lamp current has been reached. Although a summation with $\beta I$ takes place in the drive signal in the drive used in order to achieve a fast and nevertheless stable drive which realises a constant lamp voltage to a reasonable degree, the stability of the drive is limited by the choice of the value of $\beta$. $\beta$ is preferably chosen to be as small as possible for an optimal approximation of a drive of constant lamp voltage. The choice of $\beta$ also depends on the values of V and I in the balance of electrical parameters. In the case of a relatively great change of this balance, and consequently of the reference value C, the value chosen for $\beta$ will no longer be optimal and there will even be a risk of the drive becoming unstable, so that the lamp may even extinguish. This risk is counteracted by the use of the possibility offered by the window comparator of comparing the lamp voltage with a lower limit, the reference value C being restored to its original value when this limit is passed. It also contributes to a continuous correct functioning of the drive if the reference value C is caused to be adjusted somewhat gradually. A measure to counteract the influence of noise and interference signals on the drive is, for example, to average the lamp voltage over a certain period before summation and comparison with the reference value C take place.

A reduction of C means that the lamp will start to burn at a lower power. By realisation of the drive circuit in such a way that C is made smaller when the lamp voltage exceeds a preset upper level, it is achieved that the drive circuit can be relatively simple. In the operation of the drive circuit, in fact, a characteristic of every high-pressure sodium lamp can be used, i.e. that a so-called run-up phase occurs during ignition of the lamp after the discharge has started, in which phase in a stable discharge the lamp voltage gradually rises from a relatively low initial value to a stable value belonging to the stable operating state of the lamp.

The drive circuit is so designed that upon ignition of the lamp the reference value C has a value which belongs to a balance of electrical parameters whereby the lamp consumes a power in excess of the rated power. If the lamp is relatively young, the lamp voltage will show a tendency to rise to above the preset upper level during the run-up phase. When the upper level is reached, the drive circuit reduces the reference value C in steps down to the value belonging to the nominal balance of electrical parameters of the lamp. If on the other hand the lamp has aged to such an extent that a considerable blackening has occurred, the lamp voltage will still be below the upper level after the run-up phase and the reference value remains unchanged at the high level.

For a reliable operation of the drive circuit it is advisable for comparison with the lower level to take place only during the run-up phase, when it can only lead to a single adjustment of the reference value C. This requirement can be met in that a suitable degree of hysteresis of the window comparator is chosen.

BRIEF DESCRIPTION OF THE DRAWINGS

An embodiment of a switching arrangement according to the invention will be explained in more detail with reference to a drawing in which.

DESCRIPTION OF THE PREFERRED EMBODIMENT

Figure 1:
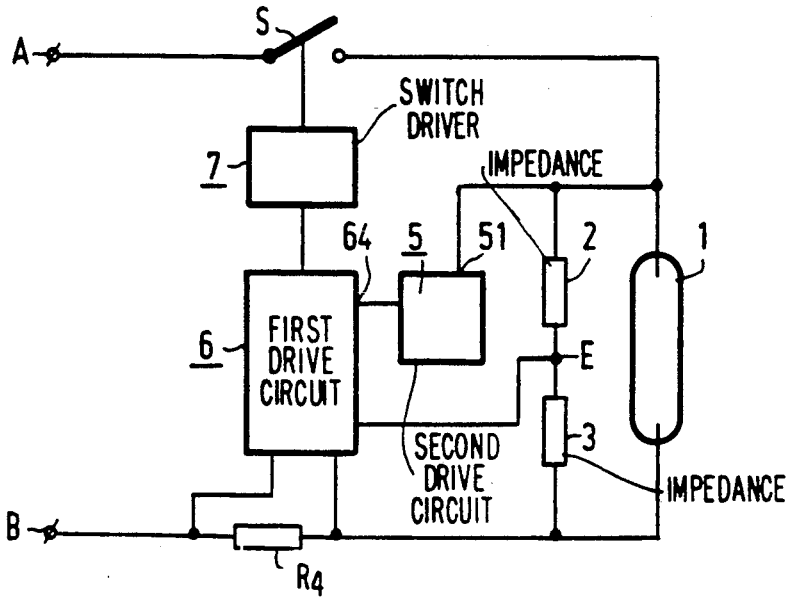
FIG. 1 is a diagrammatic representation of the switching arrangement.

In FIG. 1, A and B are terminals for connecting a supply source with which a high-pressure sodium lamp 1 can be operated in conjunction with the switching arrangement, or control circuit. The switching arrangement is provided with a switch S by way of switching means for switching current through the lamp with the aid of a drive signal generated in a first drive circuit 6 and based on a comparison between a reference value C and a drive signal in the form $V+\beta I$, in which V is the lamp voltage, I is the lamp current, and $\beta$ is a constant.

The switching device also comprises a second drive circuit 5 with means for adjusting the reference value C in dependence on the lamp voltage.

A signal representing the lamp voltage is generated at point E through a voltage divider network formed by impedances 2 and 3 and is conducted to drive circuit 6. The signal representing the lamp voltage will be referred to as lamp voltage signal hereinafter.

In analogous manner, a signal representing the lamp current is generated through a measuring resistor $R_4$ and is conducted to drive circuit 6. The signal representing the lamp current will be referred to as lamp current signal hereinafter.

Figure 2:
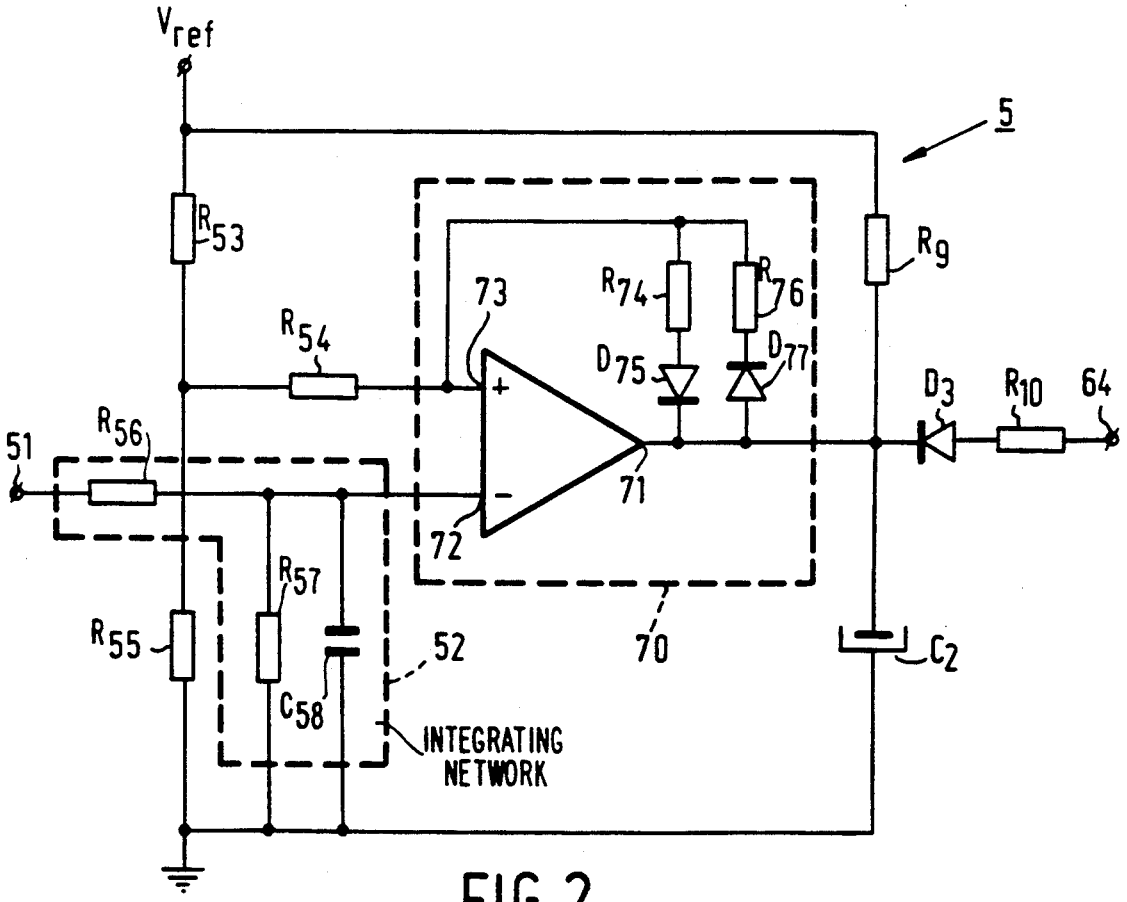
FIG. 2 is a diagram of a drive circuit.

The drive circuit 5 is shown in more detail in FIG. 2. The lamp voltage signal is applied to an inverting input 72 of a window comparator 70 via connection point 51 and an integrating network 52. The integrating network 52 serves to average the lamp voltage signal.

An output 71 of the window comparator 70 is connected to a connection point 64 of the drive circuit 6 via a diode $D_3$ and a resistor $R_{10}$. Output 71 is also connected to earth via a capacitor $C_2$ and to a reference voltage $V_{ref}$ via a resistor $R_9$.

Reference voltage $V_{ref}$ is also connected to an input 73 of the window comparator 70 via a voltage divider network $R_{53}$, $R_{54}$, $R_{55}$.

In a practical embodiment of the drive circuit, the window comparator 70 is constituted by an integrated circuit of the LM 393 type, make National Semiconductor, in which two parallel branches each comprising a resistor $R_{70}$, $R_{76}$ and a diode $D_{75}$, $D_{77}$ and connected between an input 73 and an output 71 provide the necessary feedback. The chosen integrated circuit is a type having an open collector output, so that the combination of resistor $R_9$ and capacitor $C_2$ causes the adjustment of the reference value C to take place more or less gradually.

As long as the voltage signal is below the upper level, the voltage at output 71 of window comparator 70 is high and diode $D_3$ is therefore cut off.

If the lamp voltage signal rises to above the upper level, the voltage at output 71 will fall and diode $D_3$ will become conducting. Current will start flowing through resistor $R_{10}$, so that the voltage at connection point 64 of the drive circuit drops. This voltage at connection point 64 serves as a reference voltage for forming the drive signal. The integrating network 52 consists of a resistor $R_{56}$ of 200 kΩ in series with a parallel circuit of a resistor $R_{57}$ of approximately 24 kΩ and a capacitor $C_{58}$ of 6 nF. This corresponds to an integration time of approximately 1.6 ms.

The voltage divider network with which the reference voltage $V_{ref}$ is connected to input 73 of window comparator 70 is so dimensioned that the voltage at output 71 drops when a lamp voltage signal rises to above 87 V. If the lamp voltage signal drops to below 69 V, the voltage at the output 71 will rise.

A few high-pressure sodium lamps which radiate white light under nominal operating conditions were operated with the switching arrangement. The results of a test over 5000 hours are summarized in the table below:

TABLE

| 100 h | | | | 5000 h no adjustment of C | | | | 5000 h with adjustment of C | | | |
|---|---|---|---|---|---|---|---|---|---|---|---|
| $V_{la}$ (V) | $I_{la}$ (A) | $T_c$ (K) | $P_{la}$ (W) | $V_{la}$ | $I_{la}$ | $T_c$ | $P_{la}$ | $V_{la}$ | $I_{la}$ | $T_c$ | $P_{la}$ |
| | | | | | lamp 1: | | | | | | |
| 96 | .7 | 2510 | 52 | 82 | .7 | 2350 | 57 | 88 | .7 | 2480 | 62 |
| | | | | | lamp 2: | | | | | | |
| 94 | .7 | 2560 | 52 | 79 | .7 | 2345 | 58 | 85 | .7 | 2480 | 64 |
| | | | | | lamp 3: | | | | | | |
| 94 | .8 | 2540 | 52 | 80 | .7 | 2360 | 58 | 86 | .7 | 2470 | 64 |

It is apparent from the table that the colour temperature has dropped by approximately 200 K. after 5000 hours without adjustment of the reference value C as compared with the lamp results after 100 hours.

If adjustment of the reference value C takes place, a colour temperature drop of less than 100 K. results, while the power consumed by the lamp has risen by no more than 20%.

The light radiated by the lamps has the following coordinates (x, y) in the colour triangle:

at 100 hours:

| | |
|---|---|
| lamp 1 | (.477, .415) |
| lamp 2 | (.473, .415) |
| lamp 3 | (.475, .415) |

after 5000 hours without adjustment of reference value C:

| | |
|---|---|
| lamp 1 | (.493, .418) |
| lamp 2 | (.494, .419) |
| lamp 3 | (.493, .419) |

after 5000 hours with adjustment of the reference value C:

| | |
|---|---|
| lamp 1 | (.479, .414) |
| lamp 2 | (.480, .415) |
| lamp 3 | (.480, .414) |

We claim:

1. A switching arrangement for operating a high-pressure sodium lamp which radiates white light in stable operating conditions, which switching arrangement is provided with switching means for switching current through the lamp by means of a drive signal generated in a drive circuit and derived from a comparison between a reference value C and a drive signal having the form $V+\beta I$, where V is the lamp voltage, I is the lamp current, $\beta$ is a constant, characterized in that the switching arrangement comprises a drive circuit with means for adjusting the reference value C in dependence on the lamp voltage.

2. A switching arrangement as claimed in claim 1, characterized in that the means for adjusting the reference value C serve to reduce the reference value C when the lamp voltage rises above a preset upper level.

3. A switching arrangement as claimed in claim 2, characterized in that the means for adjusting the reference value C comprise a window comparator for comparing the lamp voltage with the preset upper level.

4. A switching arrangement as claimed in claim 1, characterized in that the means for adjusting the reference value C comprise a window comparator for comparing the lamp voltage with a preset upper level.

5. A controller for operating a high pressure discharge lamp having a lamp voltage, a lamp current, and a color point which shifts over the electrical life of the lamp, said controller comprising:

switching means for controlling current through the high pressure discharge lamp;

first means connected to said switching means for generating a drive signal in the form $V+\beta I$ for controlling said switching means, where V is the lamp voltage, I is the lamp current, and $\beta$ is a constant, said first means comprising means for comparing said drive signal with a reference value C; and second means connected to said first means for adjusting the reference value C in dependence on the lamp voltage, said reference value C being adjusted for adjusting the current to the lamp over the electrical life of the lamp to stabilize its color point.

6. A controller according to claim 5, wherein said second means comprises means for comparing the lamp voltage to an upper preset level, said second means reducing the reference value C when the lamp voltage rises above the upper preset level.

7. A controller according to claim 6, wherein said second means comprises means for comparing the lamp voltage to a lower preset level, said second means raising the reference value C when said lamp voltage is below said lower preset level.

8. A controller according to claim 7, wherein the high pressure discharge lamp has a run-up period after lamp ignition in which the lamp voltage increases from an initial value to a higher stable value, said reference value C has an original value prior to lamp ignition, said second means restoring the reference value C to said original value when said lamp voltage falls below said lower limit.

9. A controller according to claim 8, wherein said second means gradually adjusts the reference value C.

10. A controller according to claim 9, further comprising means for averaging the lamp voltage over a predetermined time period, said second means comparing the average of the lamp voltage over said time period with said reference value C.

11. A controller according to claim 5, wherein said second means comprises means for comparing the lamp voltage to a lower preset level, said second means raising the reference value C when said lamp voltage is below said lower preset level.

12. A controller according to claim 5, further comprising means for averaging the lamp voltage over a predetermined time period, said second means comparing the average of the lamp voltage over said time period with said reference value C.

13. A control circuit for operating a high pressure discharge lamp having a lamp voltage, a lamp current, and color point which shifts over the lamp's electrical life, said control circuit comprising:

a switching circuit comprising a switch for controlling current through the high pressure discharge lamp;

a first circuit connected to said switching circuit for generating a drive signal in the form $V+\beta I$ for controlling said switching circuit, where V is the lamp voltage, I is the lamp current, and $\beta$ is a constant, said first circuit comprising a lamp voltage signal input, a lamp current signal input, means for comparing said drive signal with a reference value C, and a reference input for receiving a first reference voltage signal representative of reference value C;

a second circuit for adjusting the first reference voltage in dependence on the lamp voltage, said second circuit comprising a window comparator having a first inverting input, a second input, and an output supplying said first reference voltage to said reference input of said first circuit;

means for supplying a lamp voltage signal to said lamp voltage input of said first circuit and to said inverting input of said second circuit;

means for supplying a lamp current signal to said lamp current input of said first circuit; and means for supplying a second reference voltage to said second input of said comparator and to said output of said comparator, said second reference voltage being representative of an upper lamp voltage limit, said comparator output being connected to said reference input of said first circuit and to the second reference voltage such that said first reference voltage decreases if the lamp voltage signal rises above the second reference voltage.

14. A control circuit according to claim 13, wherein said second circuit further comprises an integrating network for averaging the lamp voltage signal supplied to said inverting input of said comparator.

15. A control circuit according to claim 13, wherein said window comparator consists of an integrated circuit having an open collector output connected in said control circuit such that the adjustment of reference value C by said second circuit means is accomplished gradually.

* * * * *